US011103744B2

(12) United States Patent
Munar

(10) Patent No.: US 11,103,744 B2
(45) Date of Patent: Aug. 31, 2021

(54) FOLDABLE PORTABLE TREADMILL

(71) Applicant: U Treadmill LLC, Levittown, PA (US)

(72) Inventor: JohnPaul Munar, Levittown, PA (US)

(73) Assignee: U Treadmill LLC, Levittown, PA (US)

( * ) Notice: Subject to any disclaimer, the term of this patent is extended or adjusted under 35 U.S.C. 154(b) by 0 days.

(21) Appl. No.: 16/623,197

(22) PCT Filed: Jun. 20, 2018

(86) PCT No.: PCT/US2018/038406
§ 371 (c)(1),
(2) Date: Dec. 16, 2019

(87) PCT Pub. No.: WO2018/236945
PCT Pub. Date: Dec. 27, 2018

(65) Prior Publication Data

US 2020/0406089 A1 Dec. 31, 2020

Related U.S. Application Data

(60) Provisional application No. 62/524,021, filed on Jun. 23, 2017.

(51) Int. Cl.
*A63B 22/02* (2006.01)

(52) U.S. Cl.
CPC ..... *A63B 22/0292* (2015.10); *A63B 22/0235* (2013.01); *A63B 22/0285* (2013.01); *A63B 2210/50* (2013.01)

(58) Field of Classification Search
CPC ..... A63B 22/0235; A63B 22/0285; A63B 22/0282; A63B 2210/50
See application file for complete search history.

(56) References Cited

U.S. PATENT DOCUMENTS 4,204,673 A * 5/1980 Speer, Sr. ..... A63B 22/0012 198/817
5,372,560 A * 12/1994 Chang ..... A63B 21/157 482/51
2004/0214693 A1* 10/2004 Piaget ..... A63B 22/0235 482/52

* cited by examiner

*Primary Examiner* — Jennifer Robertson
(74) *Attorney, Agent, or Firm* — Norman E. Lehrer

(57) ABSTRACT

The foldable portable treadmill (10) of the present invention includes left and right treadmill sections (12, 14), each having support rollers (20, 22) and an endless belt (24, 26) with bumps (36, 38) on the outer surface thereof. An electric motor (32) drives the belts. A hinge (40, 42) connects the side edges (16, 18) of the treadmill sections together so that they can be folded over each other for storage or transport. Wheels or rollers (84, 86) carried by at least one of the sections allow the treadmill (10) to be rolled across a floor when the sections are folded together. Telescoping handles (66, 68) are movable between an operative position where they extend upwardly from the treadmill sections when they are opened in order to be grasped by a person using the treadmill and an inoperative position where they can be used for transporting the treadmill when it is closed. When the treadmill sections are open for use, the spacing between them can be adjusted.

7 Claims, 5 Drawing Sheets

FOLDABLE PORTABLE TREADMILL

TECHNICAL FIELD

The present invention is directed toward a foldable portable treadmill and, more particularly toward such a treadmill that is lightweight and which can be easily carried around from one location to another whenever desired.

BACKGROUND ART

With the increased attention given to health awareness, the proliferation of exercise equipment has expanded from gyms and health spas and the like to both residential and office settings. One popular type of exercise equipment used by many people to keep in shape is a treadmill. A treadmill typically comprises an endless belt trained around a pair of spaced apart rollers that allows a person to walk or jog while remaining in the same position. An electric motor of variable speed may be utilized to move the belt around the rollers. In addition, an electronic console is frequently used with the treadmill to provide information about a workout and to monitor the status of a user while exercising. For example, the electronic console may provide, among other things, information on pre-programmed exercise routines, the time spent exercising, the number of calories burned, the heart rate information, as well as the distance traveled.

One drawback to the use of previously available treadmills is the size and weight thereof. This makes it difficult to store when not in use. Previously known treadmills tend to have a relatively large footprint, making them unsuitable for the confined spaces of some homes and offices. And since treadmills are typically used for only a relatively short period of time in any given day, the relatively large area needed to store the equipment may not be justified in the eyes of some consumers.

The large size and weight of conventional treadmills also makes it extremely difficult, if not impossible, to move them from place to place. Thus, if a person desires to exercise with a treadmill in both his or her home and office, two treadmills are required. Similarly, with conventional treadmills, a person owning a vacation home or the like would have to own two treadmills. And, of course, it would be impossible for a person traveling to carry his or her treadmill with them.

Some attempts have been made in the past to limit the storage space required for treadmills. However, with all such attempts known to Applicant, the equipment is still large and heavy and impossible to carry around to a new location. Several proposals have also been made to create folding treadmills but, again, these are heavy and impossible to carry around.

There is, therefore, a need for a lightweight treadmill that can be collapsed into a relatively small size so that it can be easily carried around from one location to another whenever desired and that can be easily stored when not in use.

SUMMARY OF THE INVENTION

The present invention is designed to overcome the deficiencies of the prior art discussed above. It is an object of the present invention to provide a treadmill that is lightweight and which can be easily carried from one location to another.

It is another object of the present invention to provide such a treadmill that can be easily and quickly folded for carrying and unfolded for use as desired.

It is a still further object of the present invention to provide such a treadmill that includes wheels and a handle so that a person can easily transport the folded treadmill to move the same from one place to another.

In accordance with the illustrative embodiments demonstrating features and advantages of the present invention, there is provided a foldable portable treadmill that includes left and right treadmill sections, each having support rollers and an endless belt with bumps on the outer surface thereof. An electric motor carried by one of the treadmill sections drives both belts. A hinge connects the side edges of the treadmill sections together so that they can be folded over each other for storage or transport. Wheels or rollers carried by at least one of the sections allow the treadmill to be rolled across a floor when the sections are folded together. Telescoping handles are movable between operative positions wherein they extend upwardly from the treadmill sections when they are opened in order to be grasped by a person using the treadmill and inoperative positions wherein they can be used for transporting the treadmill when it is closed. When the left and right treadmill sections are in their operative position, the spacing between them can be adjusted.

Other objects, features, and advantages of the invention will be readily apparent from the following detailed description of the preferred embodiment thereof taken in conjunction with the drawings.

DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
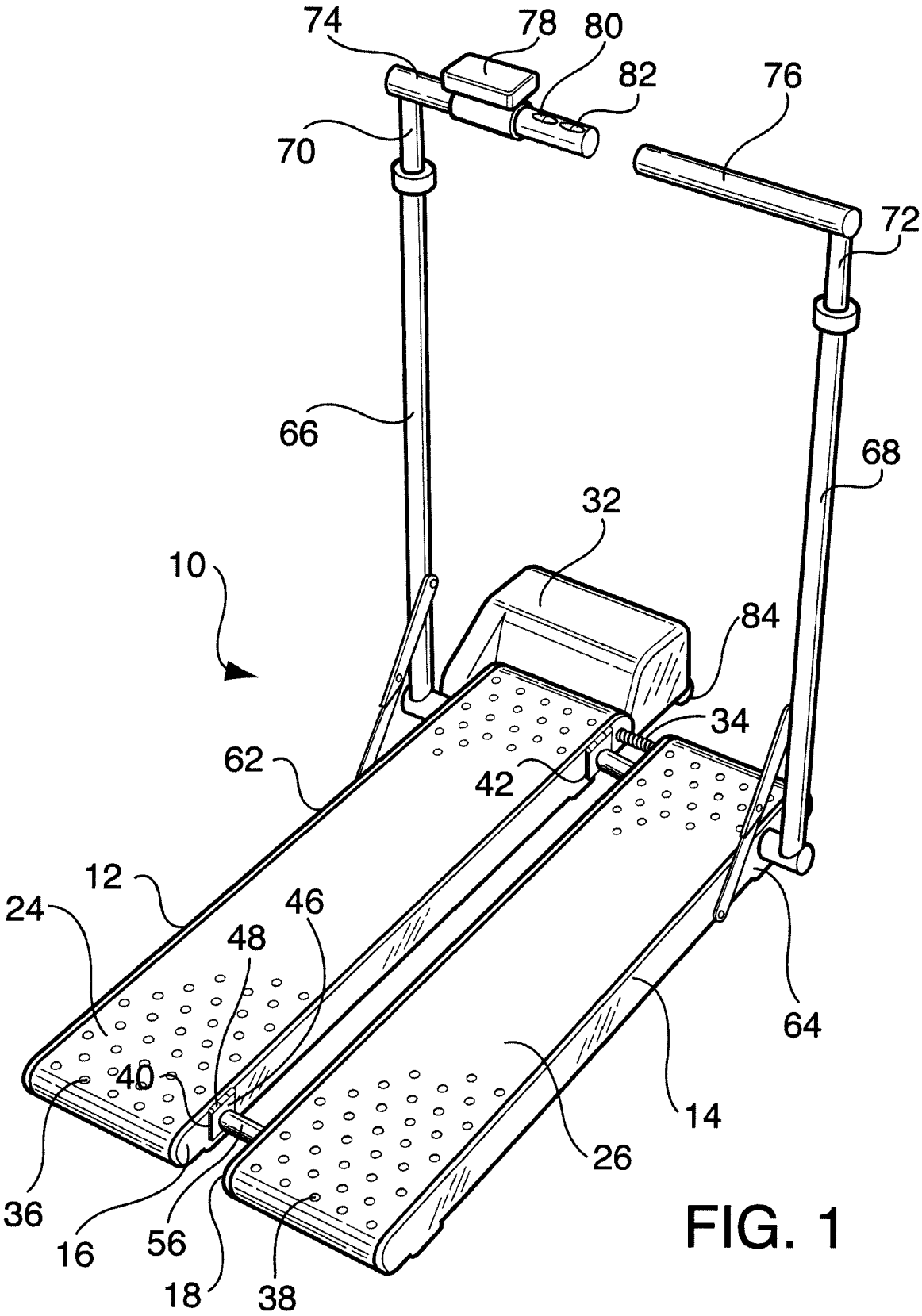
FIG. 1 is a front perspective view of the foldable portable treadmill of my invention showing the same opened and ready for use.

Referring now to the drawings in detail wherein like reference numerals have been used throughout the various figures to designate like elements, there is shown in FIGS. 1-6 a foldable portable treadmill constructed in accordance with the principles of the present invention and designated generally as 10. The foldable portable treadmill 10 is comprised essentially of left and right treadmill sections 12 and 14 which are substantially identical to each other. Each of the two treadmill sections 12 and 14 includes an inner side edge 16 and 18 that are adjacent to each other.

Each of the left and right treadmill sections 12 and 14 is, itself, somewhat of a conventional treadmill in that it includes support rollers such as shown at 20 and 22. While only the rollers at the top end of the sections are shown, those skilled in the art will understand that similar rollers are also present at the other end of the sections. The left and right treadmill sections 12 and 14 also include substantially conventional endless belts 24 and 26 that ride over support surfaces 28 and 30 (see FIGS. 5 and 6). An electric motor 32 of conventional construction drives the endless belts 24 and 26 by driving the roller 20 directly and the roller 22 through the use of a flexible drive cable 34 or the like. As shown in the figures, the endless belts 24 and 26 define the upper surfaces of the treadmill sections 12 and 14.

Since the support rollers and motor means are substantially conventional, it is not believed that they need be described in detail. The motor means may be a conventional electric motor that could be battery powered or be required to be plugged into an electrical outlet. Since the treadmill sections 12 and 14 may be relatively small and light compared to a standard treadmill, the electric motor can be relatively small. In the preferred embodiment of the invention, only one motor is used for driving both treadmill sections 12 and 14. It is not beyond the scope of the present invention, however, to use two separate motors. It is also not beyond the scope of the present invention to eliminate the motor and allow the belts 20 and 22 to be free moving as with some other prior art treadmills that do not utilize motor means.

Because only one foot is utilized on each of the two treadmill sections 12 and 14, each section can be made relatively small. The width of each section could be as little as 1 foot but preferably is closer to 2 feet wide. Similarly, the length can be relatively short and preferably is in the range of 2 to 3 feet. Obviously other sizes are also possible but it is preferred to make the left and right treadmill sections 12 and 14 relatively small and light for easy transporting.

Although the belts 24 and 26 are somewhat conventional and driven in a conventional manner, it is preferred that they include a plurality of bumps or raised portions thereon such as shown at 36 and 38. These help to massage a person's foot as he or she is walking on the treadmill.

Figure 3:
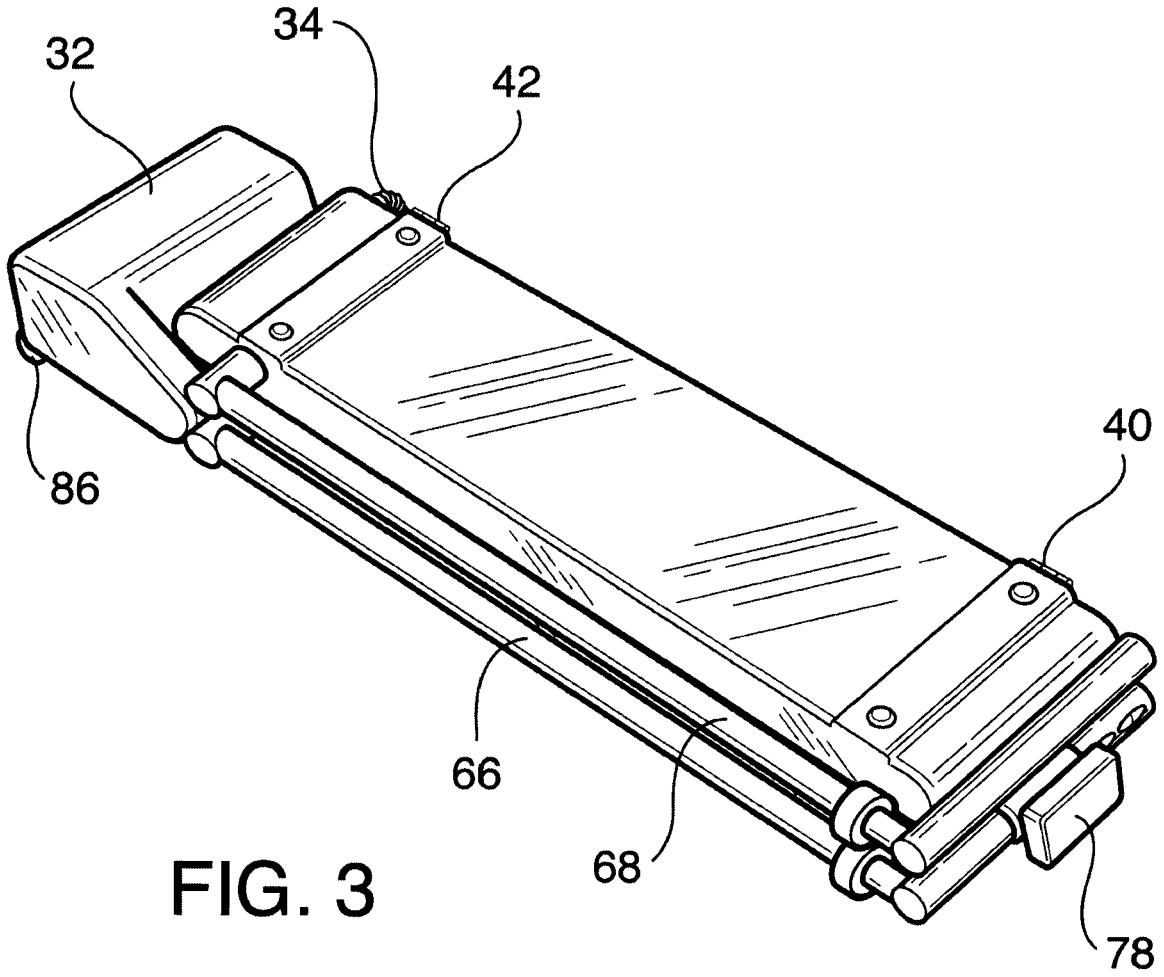
FIG. 3 is a perspective view showing the treadmill folded and ready to be moved or stored away.
Figure 4:
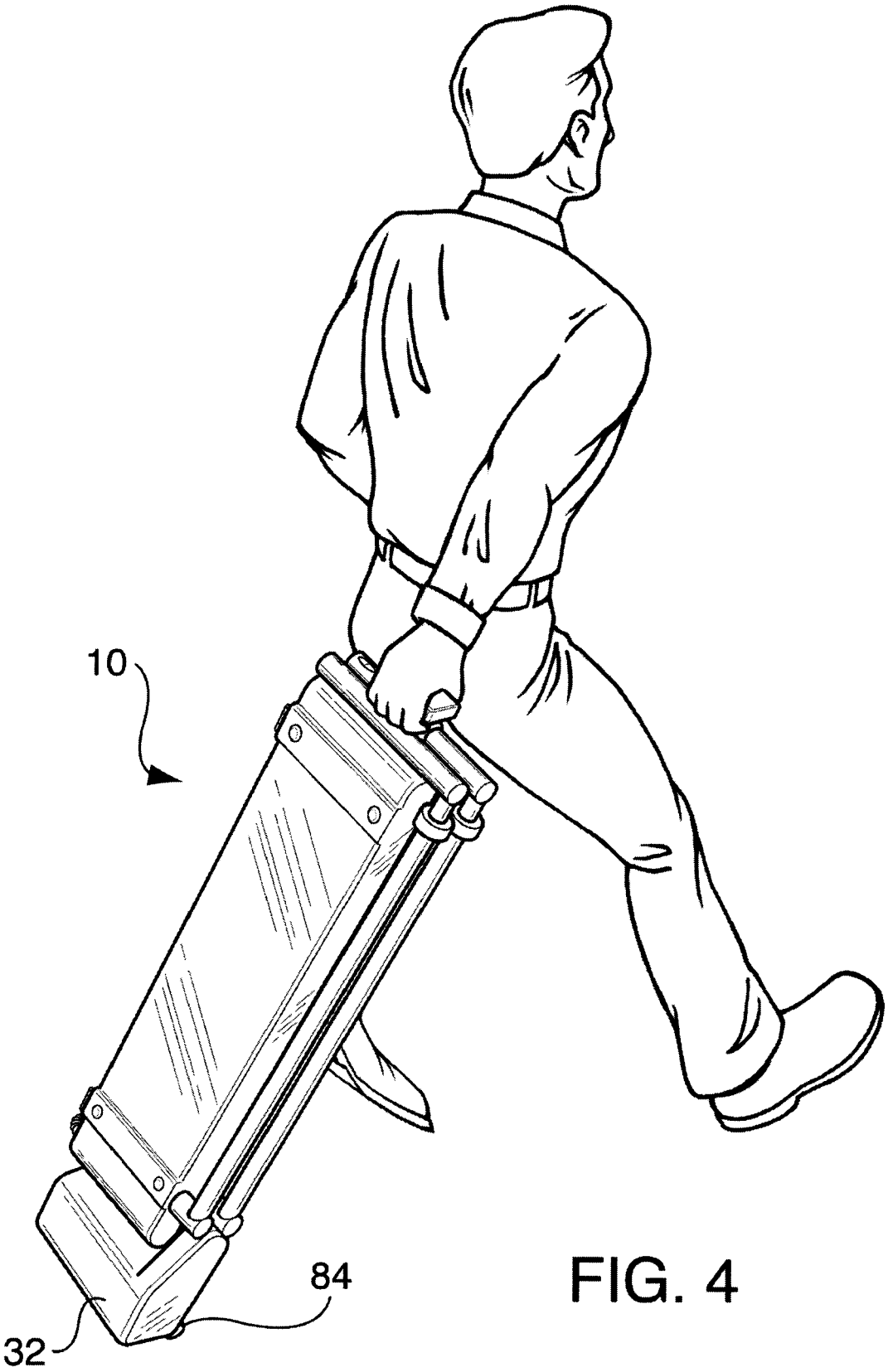
FIG. 4 illustrates how the foldable portable treadmill of my invention can be easily transported from place to place.

Located between the two side edges 16 and 18 of the treadmill sections 12 and 14 are hinge means 40 and 42. These hinge means connect the side edges of the two treadmill sections together but allow them to be moved between the opened operable position as shown in FIG. 1 where the sections lie side-by-side next to each other for exercising and a closed position as shown in FIGS. 3 and 4 wherein the upper surfaces lie on top of each other for storing or transporting the treadmill.

The hinge means 40 and 42 are identical and function in the same way. Accordingly, only hinge means 40 will be described in detail, it being understood that hinge means 42 is constructed in the same manner.

Figure 5:
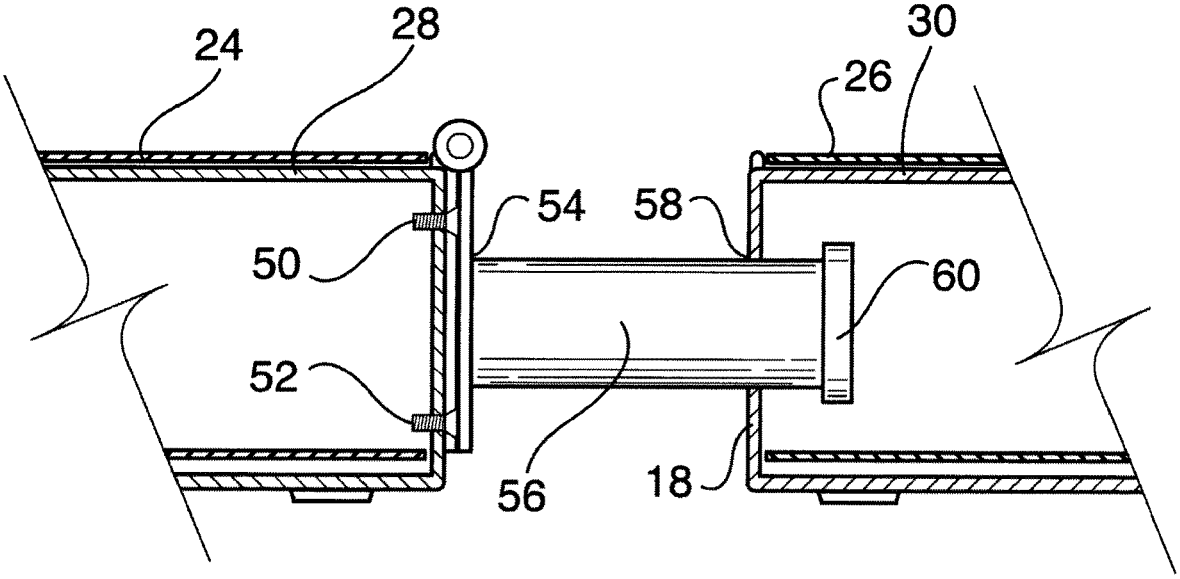
FIG. 5 is a cross-sectional view showing the hinge and extension means that allow the spacing between the two treadmill sections to be adjusted.
Figure 6:
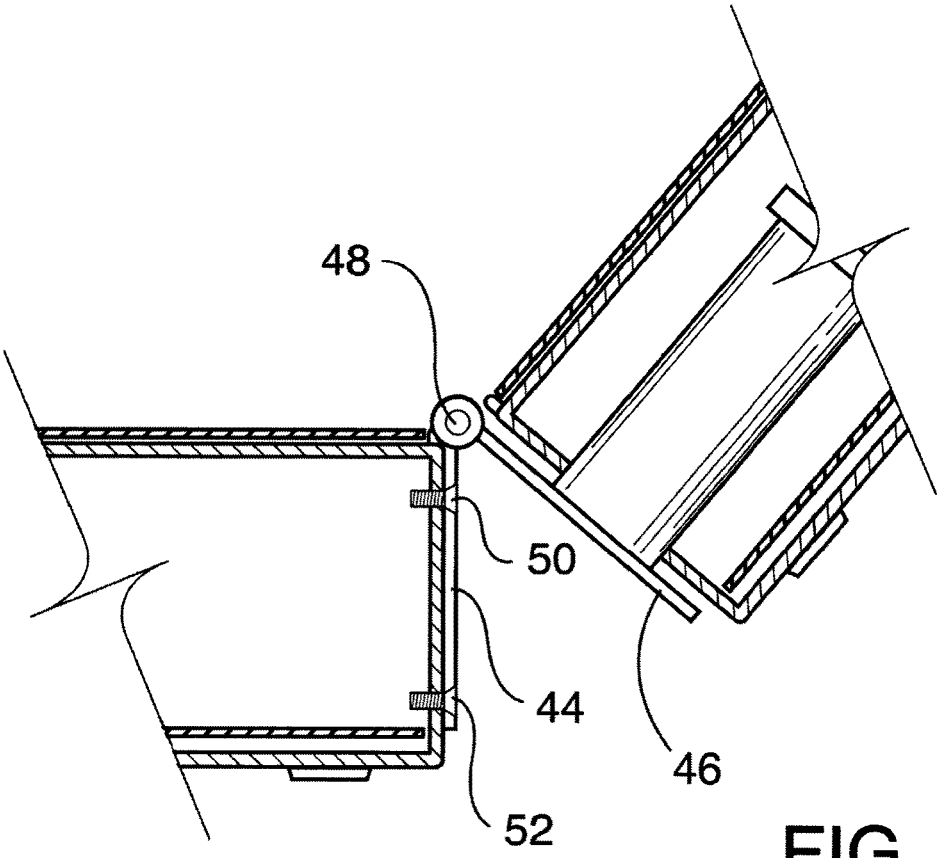
FIG. 6 is a cross-sectional view similar to FIG. 5 showing how the hinge means allows the two treadmill sections to be folded.

Referring now to FIGS. 5 and 6, it can be seen that hinge means 40 is, per se, conventional. It includes a first plate 44 and a second plate 46 that are pivoted together through pivot pin 48. The first plate 44 is secured to the side edge 16 of the left treadmill section 12 through the use of screws 50 and 52. The outer surface of the other plate 46 supports a first end 54 of an elongated rod 56. The rod 56 extends through opening 58 in the side edge 18 of the treadmill section 14 and is capable of freely sliding within the opening 58. The enlarged end 60 of the elongate rod 56 prevents the end of the rod from passing through the opening 58.

As should be readily apparent to those skilled in the art the arrangement of the hinge means 40 and the elongated rod 56 allows the left and right treadmill sections 12 and 14 to move toward or away from each other when in the operative position. By doing this, the treadmill of the present invention can be used by people of different sizes while still maintaining a compact unit. That is, larger people whose legs may be further apart can simply move the left and right treadmill sections 12 and 14 further away from each other when being used. The width of each section can still be relatively narrow. Before folding the two sections, they are preferably moved together.

Figure 2:
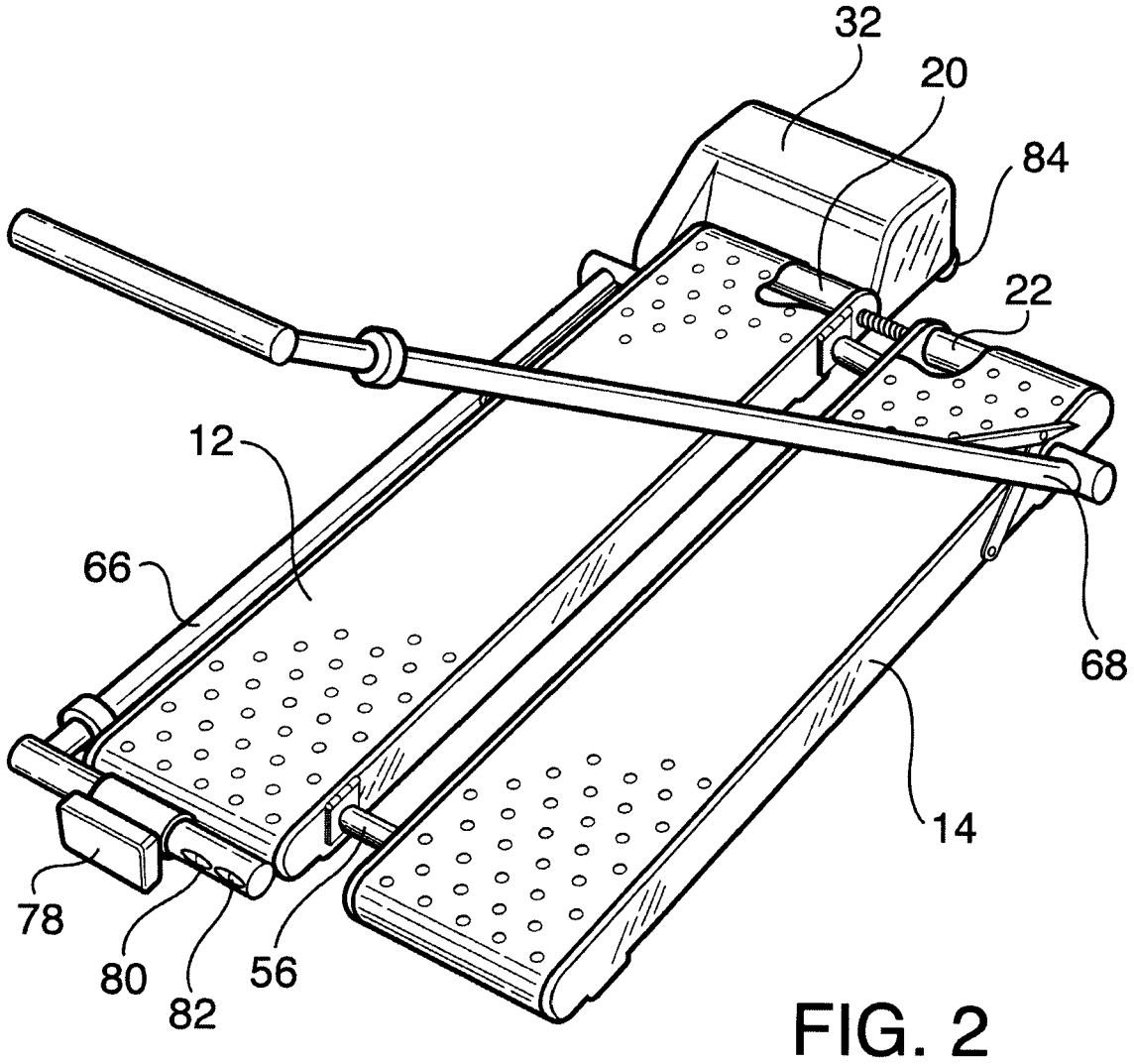
FIG. 2 is a front perspective view of the foldable portable treadmill similar to FIG. 1 but showing the handles being folded down.

Pivotally connected to the outer side edges 62 and 64 of the left and right treadmill sections 12 and 14 are handle means 66 and 68. The handle means 66 and 68 include telescoping vertical sections 70 and 72 that allow the length to be adjusted and horizontal sections 74 and 76. The horizontal section 74 includes a handle 78 and a number of control buttons 80 and 82 for controlling the motor means 32. The handle means 62 and 64 are capable of moving between an operative position such as shown in FIG. 1 and an inoperative position as shown in FIGS. 3 and 4. FIG. 2 shows left handle means 66 in the inoperative position and right handle means 68 moving into the inoperative position. The handle means 66 and 68 can be locked into either position.

When the handle means 66 and 68 are in their totally collapsed or inoperative position, the left and right treadmill sections 12 and 14 can be folded over onto each other as shown in FIG. 3. When it is desired to transport the treadmill 10, the handle 78 is grasped and lifted as shown in FIG. 4. The entire treadmill 10 can then be rolled on the rollers or wheels 84 and 86 mounted below the motor means 32.

The present invention may be embodied in other specific forms without departing from the spirit or essential attributes thereof and accordingly, reference should be made to the appended claims rather than to the foregoing specification as indicating the scope of the invention.

The invention claimed is:

1. A foldable portable treadmill comprising:

left and right treadmill sections, each of said sections having a side edge and including support rollers and an endless belt, said endless belts having upper surfaces which are the upper surfaces of said treadmill sections;

hinge means connecting said side edges of said treadmill sections together whereby said sections can be moved between an open operable position where said sections lie side by side next to each other for exercising and a closed position wherein said upper surfaces lie on top of each other;

roller means carried by at least one of said sections allowing said treadmill to be rolled across a floor when said sections are in their closed position, and handle means movable between an operative position wherein said handle means extend upwardly from said treadmill sections when they are in their open position and an inoperative position wherein the handle means can function as a handle for transporting said treadmill when said sections are in their closed position.

2. The foldable portable treadmill as claimed in claim 1 wherein said handle means is pivotally attached to at least one of said treadmill sections.

3. The foldable portable treadmill as claimed in claim 2 wherein said handle means has a length and includes a telescoping section allowing the length of the handle means to be adjusted.

4. The foldable portable treadmill as claimed in claim 1 wherein said hinge means includes means allowing said left and right treadmill sections to move toward and away from each other when they are in their open position.

5. The foldable portable treadmill as claimed in claim 1 further including a motor means for driving said belts.

6. The foldable portable treadmill as claimed in claim 5 further including control means carried by said handle for controlling said motor means.

7. The foldable portable treadmill as claimed in claim 1 wherein the upper surfaces of said endless belts include bumps thereon.

* * * * *